US010553988B2

(12) United States Patent
Koparde et al.

(10) Patent No.: US 10,553,988 B2
(45) Date of Patent: Feb. 4, 2020

(54) ANTI-ROTATION DEVICE FOR CIRCULAR CONNECTOR

(71) Applicant: HONEYWELL INTERNATIONAL INC., Morris Plains, NJ (US)

(72) Inventors: Deepak Surendra Koparde, Bangaluru (IN); Veeresh Shivaprakash Yagati, Haveri (IN); Naveen Kumar Mn, Bangaluru (IN); Brian Richards, Upper Arlington, OH (US); Tungsheng Yang, Dublin, OH (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 16/299,901

(22) Filed: Mar. 12, 2019

(65) Prior Publication Data

US 2019/0288442 A1 Sep. 19, 2019

(30) Foreign Application Priority Data

Mar. 15, 2018 (IN) ..... 201811009512

(51) Int. Cl.

| | |
|---|---|
| ***H01R 13/58*** | (2006.01) |
| ***H01R 13/512*** | (2006.01) |
| ***H01R 13/04*** | (2006.01) |
| ***H01R 13/66*** | (2006.01) |

(52) U.S. Cl.

CPC ..... *H01R 13/58* (2013.01); *H01R 13/04* (2013.01); *H01R 13/512* (2013.01); *H01R 13/6683* (2013.01)

(58) Field of Classification Search

CPC ..... H01R 13/58

See application file for complete search history.

(56) References Cited

U.S. PATENT DOCUMENTS

| | | | | |
|---|---|---|---|---|
| 4,693,538 | A * | 9/1987 | Matsuo | H01R 13/42 24/130 |
| 2001/0002348 | A1 | 5/2001 | Mountford | |
| 2005/0070141 | A1 * | 3/2005 | Dopf | E21B 17/028 439/140 |

FOREIGN PATENT DOCUMENTS

| | | | |
|---|---|---|---|
| EP | 2797176 | A1 | 10/2014 |
| EP | 3133701 | A1 | 2/2017 |
| WO | 2002/052239 | A1 | 7/2002 |

OTHER PUBLICATIONS

Extended European Search Report for Application No. 19162680.3, dated Aug. 13, 2019, 10 pages.

* cited by examiner

*Primary Examiner* — James Harvey

(74) *Attorney, Agent, or Firm* — Alston & Bird LLP

(57) ABSTRACT

Apparatus and associated methods relate to an anti-rotation device (ARD) including a cylindrical ring extending along a longitudinal axis, the ring including proximal and distal faces. In an illustrative example, the ring may include proximal coupling members extending from the proximal face insertably engaging with mating recesses within a connector-disk. The ring may include distal coupling members extending from the distal face insertably engaging with mating recesses within a body-assembly, for example. The coupling members may extend, for example, parallel to the longitudinal axis. The ARD may be captured between the connector-disk and the body-assembly and may be retained by a proximal twist-lock cap screwably engaged with the body-assembly, such that relative rotational motion between the connector-disk and the body-assembly is substantially restricted, for example. Various ARDs may substantially restrict relative rotational motion between connector-disks and body-assemblies advantageously mitigating disconnection of wiring harnesses in circular connector applications.

20 Claims, 6 Drawing Sheets

ANTI-ROTATION DEVICE FOR CIRCULAR CONNECTOR

CROSS-REFERENCE TO RELATED APPLICATIONS

This application claims priority to Indian provisional application 201811009512 entitled "Anti-Rotation Device for Circular Connector," which was filed in India by D. Koparde, et al. on Mar. 15, 2018. This application incorporates the entire contents of the above-mentioned application(s) herein by reference.

TECHNICAL FIELD

Various embodiments relate generally to mechanical accessories to electrically detachable circular connectors.

BACKGROUND

Gage and absolute sensors may be deployed in some of the world's most rugged environments. For example, various deployment environments may include operations pertaining to the include oil and gas industry. Electrical connectors used in these deployments may be designed, manufactured and tested to meet demanding specifications. Some sensor manufacturers may develop and refine their designs to meet specific end-user applications. In various examples, industry-standard DIN 43650 circular connectors may employ a fast-lock technology to avoid screwing operations, which may be viewed as cumbersome in field installation situations.

SUMMARY

Apparatus and associated methods relate to an anti-rotation device (ARD) including a cylindrical ring extending along a longitudinal axis, the ring including proximal and distal faces. In an illustrative example, the ring may include proximal coupling members extending from the proximal face insertably engaging with mating recesses within a connector-disk. The ring may include distal coupling members extending from the distal face insertably engaging with mating recesses within a body-assembly, for example. The coupling members may extend, for example, parallel to the longitudinal axis. The ARD may be captured between the connector-disk and the body-assembly and may be retained by a proximal twist-lock cap screwably engaged with the body-assembly, such that relative rotational motion between the connector-disk and the body-assembly is substantially restricted, for example. Various ARDs may substantially restrict relative rotational motion between connector-disks and body-assemblies advantageously mitigating disconnection of wiring harnesses in circular connector applications.

Various embodiments may achieve one or more advantages. For example, some implementations may extend the life of various sensors and other electronic equipment, reducing costly down-time, field diagnosis and repair operations. Various implementations may improve dependability in DIN-mounted (Deutsches Institut für Normung) electrical equipment, by avoiding twist-stress which may induce marginal wiring harness connections that pass manufacturing tests but may cause latent failures in the field. Various anti-rotation devices may be injection molded with thermoplastic withstanding up to 125° C. or more. Some examples may be cost-effectively implemented in various Honeywell electronic sensors. Various embodiments may be deployed in harsh environments, such as oil and gas applications. Some embodiments may be intuitively implemented with various connector disks and top covers. Some embodiments may include various metals and may provide a robust quality measure.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an illustrative implementation of an exemplary anti-rotation device is briefly introduced with reference to FIG. 1. Second, with reference to FIG. 2 an exemplary anti-rotation device is described in more detail. In FIG. 3, the discussion turns to exemplary features in proximate components. Finally, with reference to FIG. 4-8, various anti-rotation embodiments are presented. Throughout this document, "connector disk" may be an electrical connector that is detachable.

Figure 1:
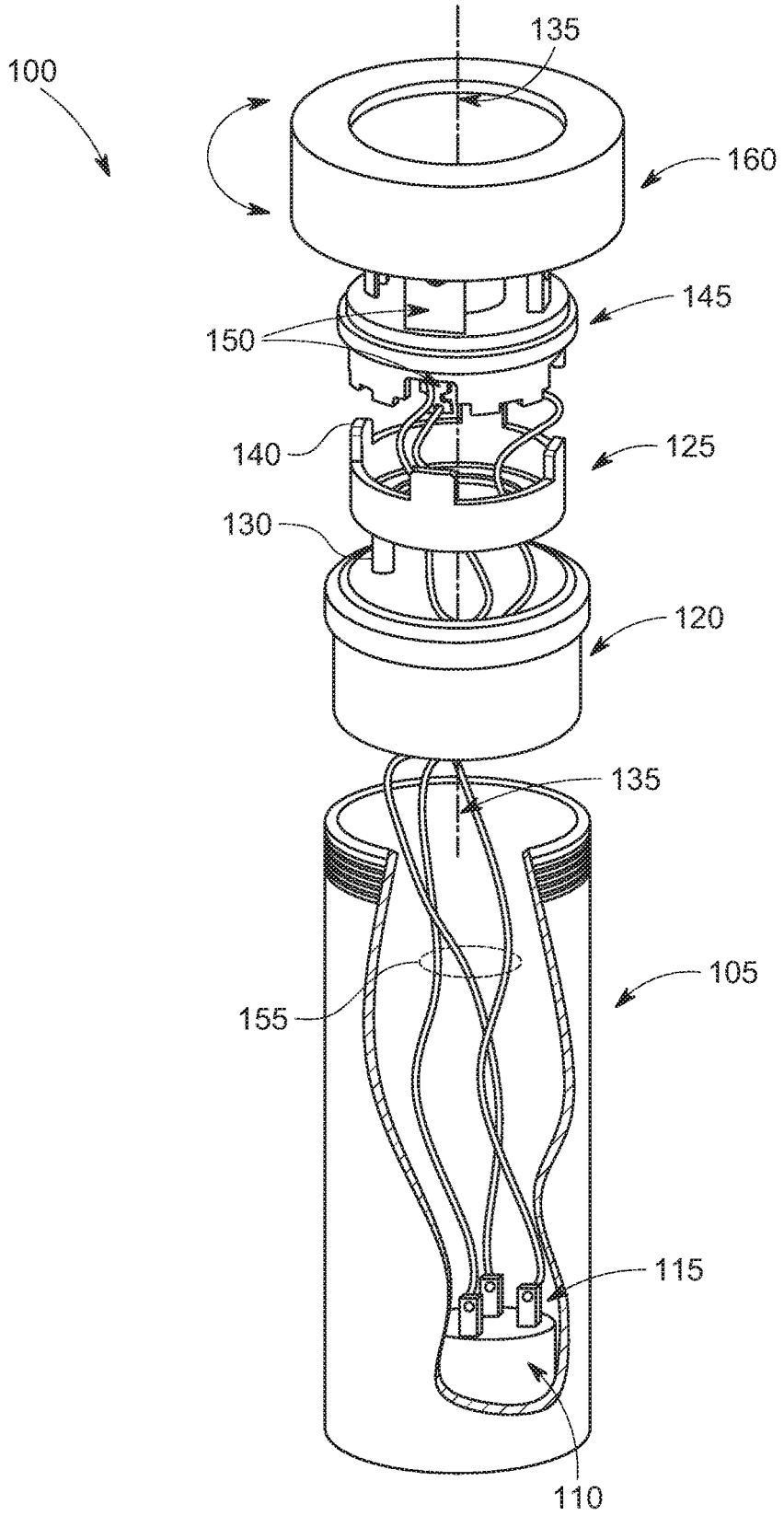
FIG. 1 depicts an exploded perspective view of an exemplary anti-rotation device incorporated within a sensor assembly stack-up including a DIN connector disk.

FIG. 1 depicts an exploded perspective view of an exemplary anti-rotation device incorporated within a sensor assembly stack-up including a DIN connector disk. A sensor assembly 100 includes a sensor body 105. The sensor body 105 is fixedly coupled to a sensing module 110. The sensing module 110 is fixedly coupled to one or more module terminals 115. The sensor body 105 is fixedly coupled to a top cover 120. An anti-rotation device 125 fits inside the top cover 120.

The anti-rotation device 125 includes one or more unitarily formed extrusions 130. The one or more extrusions 130 are configured to fit within one or more apertures (not shown) located within the top cover 120. The extrusions 130 inserted into the apertures may mitigate relative rotation between the top cover 120 and the anti-rotation device 125 about a longitudinal axis 135.

The anti-rotation device 125 includes one or more unitarily formed castellated protrusions 140. The castellated protrusions 140 are configured to fit within various recesses in a connector disk 145. The connector disk 145 is fixedly coupled to one or more connector terminals 150. The connector terminals 150 are operatively coupled to the module terminals 115 via a wiring harness 155. In various embodiments, the connector disk 145 may be a DIN 43650 male connector. The castellated protrusions 140 inserted into the recesses may mitigate relative rotation between the connector disk 145 and the anti-rotation device 125 about the longitudinal axis 135.

Accordingly, the anti-rotation device 125 may mitigate relative rotation between the top cover 120 and the connector disk 145. Since the top cover 120, the sensor body 105, the sensing module 110 and the module terminals 115 are all in fixed spatial relationships, and since the anti-rotation device 125 holds the top cover 120 and the connector disk 145 in a fixed rotational relationship, then the connector terminals 150 and the module terminals 115 may be advantageously held in a fixed rotational relationship about the longitudinal axis 135. This fixed rotational relationship may advantageously mitigate twisting stresses of the wiring harnesses 155 about the longitudinal axis 135.

The top cover 120, the anti-rotation device 125 and the connector disk 145 are captured and held within the sensor body 105 by a twist-lock cap 160. Although a bottom-facing inside surface of the twist-lock cap 160 is in contact with a top surface of the connector disk 145 while the twist-lock cap 160 is rotated with respect to the sensor body 105, the connector disk 145 may remain in a fixed rotational relationship with the sensor body 105, the sensing module 110 and the module terminals 115 due to the inclusion of the anti-rotation device 125.

The anti-rotation device 125 may mitigate twisting stresses during manufacture of the sensor assembly 100, reducing the occurrence of compromised connections on the wiring harness 155. Mitigation of compromised connections on the wiring harness 155 may advantageously increase the working life and overall quality of various sensor assemblies 100.

The anti-rotation device 125 may mitigate twisting stresses in the field due to vibration, in various implementations. For example, an industrial machine may include a sensor assembly, such as sensor assembly 100 implemented with a DIN 43650 connector. As the machine vibrates, rotation of the connector disk 145 with respect to the internal sensing module 110 may be mitigated. The wiring harness 155 remains intact during deployment, which may avoid latent failure and expensive down-time.

In various examples, a body-assembly may include the sensor body 105, the sensing module 110, the module terminals 115, the top cover 120, and the wiring harnesses 155. The components making up the body-assembly may be fixedly coupled to one another. In some examples, the wiring harness 155 may be fixedly coupled on a distal end, to the module terminals 115. During various assembly processes, the body-assembly, via the wiring harness 155, may be fixedly coupled on a proximal end, to the connector-disk 145.

Figure 2:
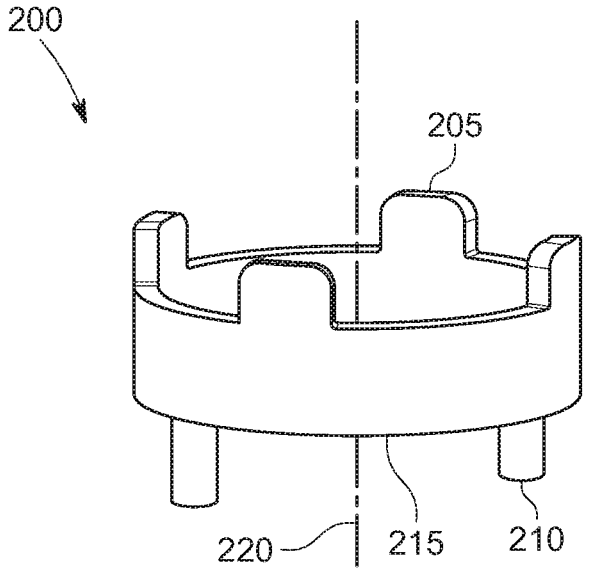
FIG. 2 depicts a perspective view of an exemplary anti-rotation device.
Figure 3:
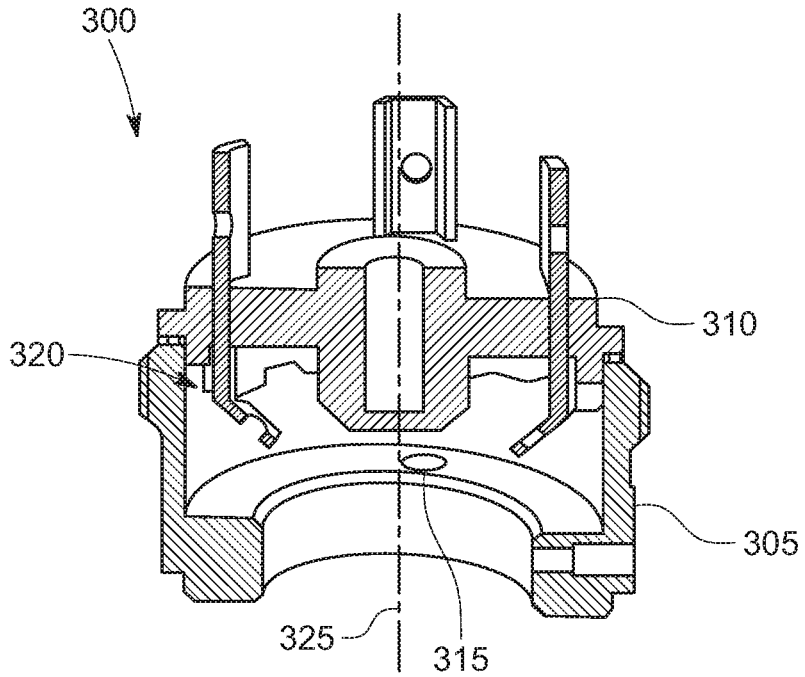
FIG. 3 depicts a perspective view of an exemplary anti-rotation device anchor point in an exemplary top cover.

FIG. 2 depicts a perspective view of an exemplary anti-rotation device. An anti-rotation device 200 includes one or more castellations 205. The anti-rotation device 200 includes one or more pins 210. The castellations 205 and the pins 210 are fixedly coupled to a cylindrical ring 215. In the depicted example, the castellations 205 protrude proximally (e.g., upward), and the pins protrude distally (e.g., downward) from the cylindrical ring 215. The one or more castellations 205 may hold a connector (e.g., FIG. 1, connector disk 145) from rotating with respect to an assembly body (e.g., FIG. 1, sensor body 105) during various manufacturing operations. In some examples, the pins 210 may be locating features to facilitate user assembly of various anti-rotation devices (e.g., anti-rotation device 200) into a proper position. An inherent shear strength of the pins 210 and/or the castellations 205 may resist substantially high torque about a longitudinal axis 220. The pins 210 and the castellations 205 may provide resistance to one or more degrees of freedom. In some implementations, "substantially high torque" may include anti-rotation device pins 210 and/or castellations 205 withstanding torques applied to anti-rotation devices 200 of up to, for example, about 1, 2, 3, 4, 5, 6, 7, 8, 9, 10, 12, 14, 16, 18, 20, 25, 30, 35, or up to about 40 Nm or more.

FIG. 3 depicts a perspective view of an exemplary anti-rotation device anchor point in an exemplary top cover. A sensor subassembly 300 includes an exemplary top cover 305. A connector disk 310 is proximate to, and concentrically seated on top of the top cover 305. In various examples, an anti-rotation device (e.g., FIG. 2, anti-rotation device 200) may be sandwiched between the top cover 305 and the connector disk 310. The top cover 305 may include an anchoring aperture 315. The anchoring aperture 315 may mate with a pin (e.g., FIG. 2, pin 210) of the anti-rotation device. The connector disk 310 may include one or more slots 320 on a bottom side. The one or more slots may mate with a castellation (e.g., FIG. 2 castellation 205). An anti-rotation device, located between the top cover 305 and the connector disk 310 may hold the top cover 305 and the connector disk 310 in a fixed rotational relationship about a longitudinal axis 325.

Figure 4A:
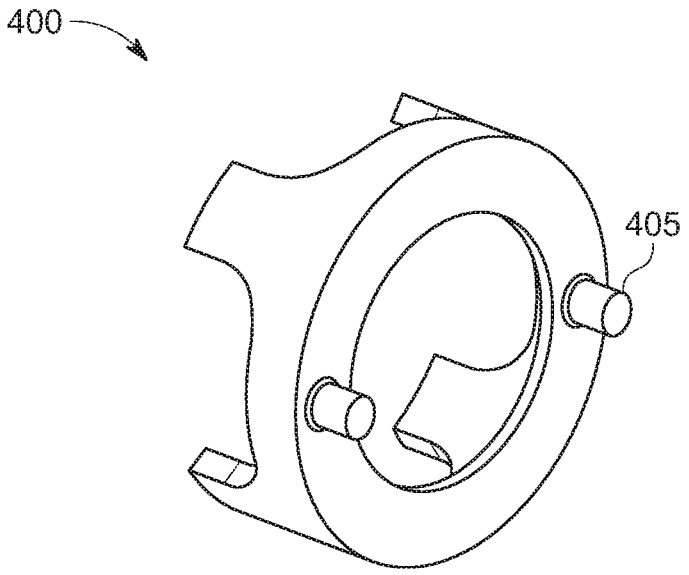
FIG. 4A depicts a perspective bottom view of an exemplary anti-rotation device.
Figure 4B:
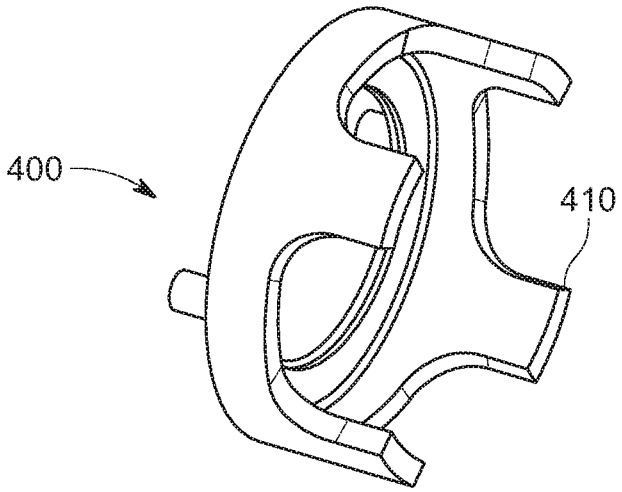
FIG. 4B depicts a perspective top view of an exemplary anti-rotation device.
Figure 4C:
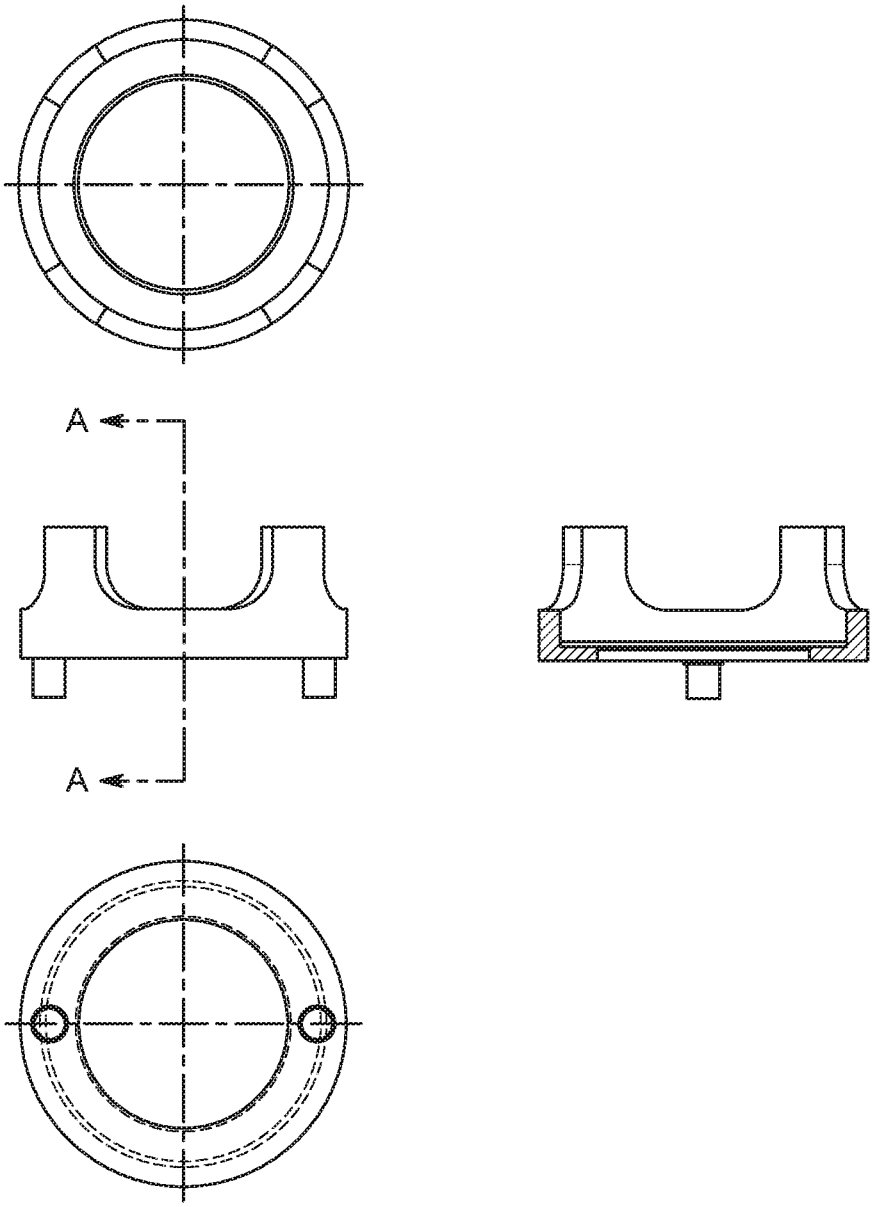
FIG. 4C depicts a mechanical drawing of an exemplary anti-rotation device.

FIG. 4A depicts a perspective bottom view of an exemplary anti-rotation device. An anti-rotation device 400 is fixedly coupled to two anti-rotation pins 405. In various examples, the anti-rotation device 400 may include one or more anti-rotation pins 405. FIG. 4B depicts a perspective top view of the exemplary anti-rotation device 400. The anti-rotation device 400 is fixedly coupled to four anti-rotation tabs 410. In various examples, the anti-rotation device 400 may include one or more anti-rotation tabs 410. FIG. 4C depicts a mechanical drawing of an exemplary anti-rotation device having exemplary dimensions.

Figure 5:
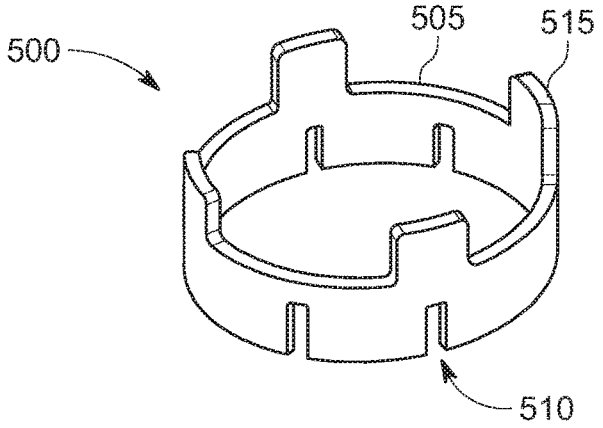
FIGS. 5, 6, 7 and 8 depict perspective views of exemplary anti-rotation devices.

FIG. 5 depicts a perspective view of exemplary anti-rotation device. In the depicted example, an anti-rotation device 500 includes a ring 505. The ring 505 includes one or more slots 510. In the depicted example, the slots 510 are disposed around the lower circumference of the ring 505, each slot 510 having an axis radial to the axis of the ring 505. The ring 505 includes one or more protruding tabs 515. In the depicted example, the tabs 515 are unitary with the ring 505 and protrude upward from an upper circumference of the ring 505.

Figure 6:
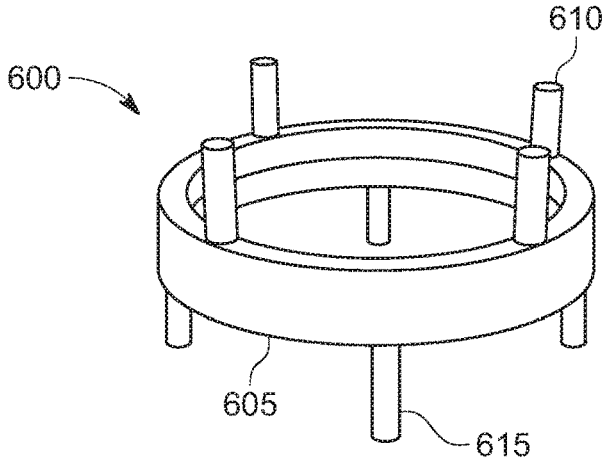

FIG. 6 depicts a perspective view of exemplary anti-rotation device. In the depicted example, an anti-rotation device 600 includes a ring 605. The ring 605 is fixedly coupled to one or more top side pins 610 and one or more bottom side pins 615.

Figure 7:
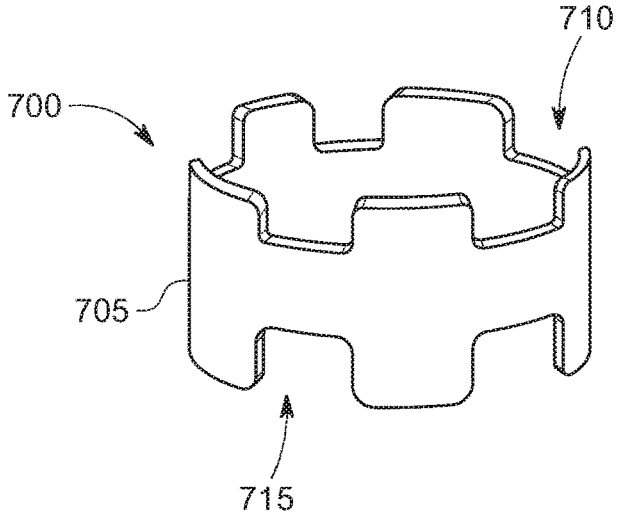

FIG. 7 depicts a perspective view of exemplary anti-rotation device. In the depicted example, an anti-rotation device 700 includes a unitary ring 705. The unitary ring 705 includes one or more top castellated slots 710 and bottom castellated slots 715.

Figure 8:
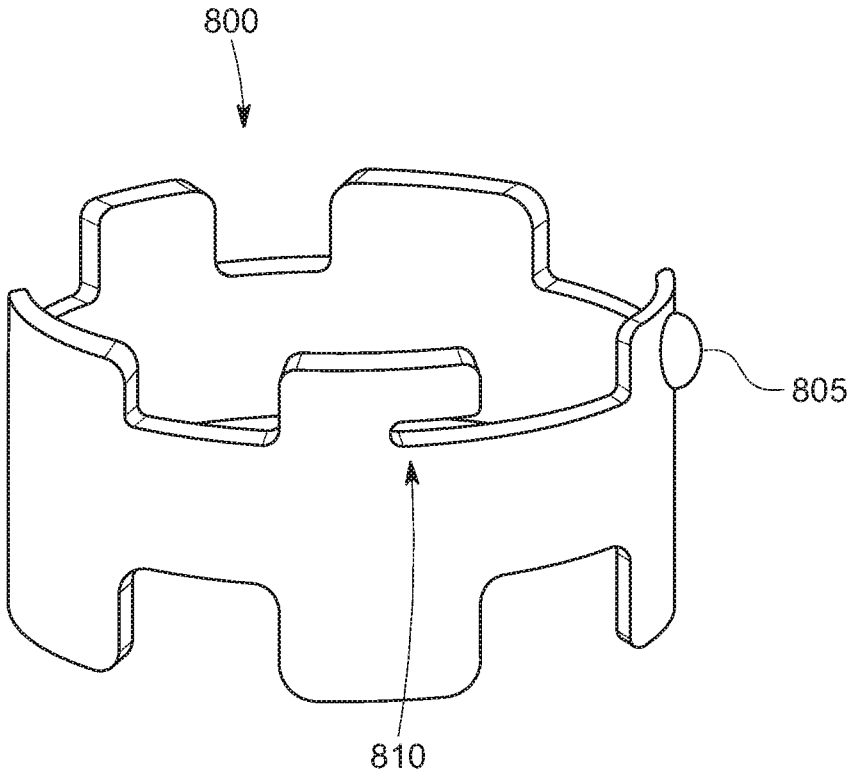

FIG. 8 depicts a perspective view of exemplary anti-rotation device. In the depicted example, an anti-rotation device 800 includes a detent 805 and a slot 810. The anti-rotation device 800 may include one or more detents 805 and/or slots 810. The slots 810 and detents 805 may aid in manufacture of the anti-rotation device 800. For example, various slots 810 and/or detents 805 may provide a snap-in-place feature, holding the anti-rotation device 800 in place while the rest of the assembly comes together.

Although various embodiments have been described with reference to the figures, other embodiments are possible. For example, various anti-rotation devices may be press-fit into a top cover (e.g., FIG. 1, top cover 120).

In an exemplary aspect, an anti-rotation apparatus may fit within a cylindrical sensor assembly. The cylindrical sensor assembly may include a cylindrical housing. The cylindrical housing may be proximate to a connector disk. The anti-rotation apparatus may substantially restrict a relative motion between a connector disk and a cylindrical housing. In various implementations, "substantially restrict" may be characterized by relative motion, for example, of about 0° or less than about 1°, 2°, 3°, 4°, 5°, 6°, 7°, 8°, 9° or about 10°.

The anti-rotation apparatus may include a substantially shallow and hollow cylindrical housing having a first longitudinal axis. The substantially shallow cylindrical housing may be a cylindrical ring. The anti-rotation apparatus may include one or more protrusions extending downward from the bottom of the cylindrical ring. In some examples, the protrusions may include a second longitudinal axis substantially parallel to the first longitudinal axis. The anti-rotation apparatus may include one or more extrusions extending upward from the top of the cylindrical ring. In some examples, the extrusions may include a third longitudinal axis substantially parallel to the first longitudinal axis. In various examples, "substantially parallel" angle deltas may be, for example, about 0° or about 1°, 2°, 3°, 4°, 5°, 6°, 7°, 8°, 9° or up to about 10° or more. In various examples, "substantially shallow" cylindrical housings may be characterized as having a depth of about 0.1", 0.2", 0.3", 0.4". 0.5". 0.6", 0.7". 0.8", 0.9" or up to about 1.0" or more.

In various implementations, the protrusions may be press-fit into the ring. For example, the protrusions may be a cylindrical metal pin, which may be press-fit into the ring. The ring may include various synthetic materials and/or polymers (e.g., plastics, nylon, urethane). In some examples, the ring may include rubber.

In various implementations, the cylindrical ring, the protrusions and the extrusions may be integrally formed in a mold. For example, various integrally formed anti-rotation devices may be injection molded. Various exemplary anti-rotation devices may be manufactured with two-plate molds. In various examples, the anti-rotation device may be stamped sheet steel. Further, various anti-rotation devices may be stamped or die-cut sheet plastic.

Some embodiments may include various polymers. For example, nylon may be included in various anti-rotation devices and may provide strong rotational resistance cost-effectively. Nylon may provide resistance to substantially high torque. In some implementations, "substantially high torque" may include anti-rotation device withstanding torques, for example, of up to about 1, 2, 3, 4, 5, 6, 7, 8, 9, 10, 12, 14, 16, 18, 20, 25, 30, 35, or up to about 40 Nm or more.

In some examples, the anti-rotation devices may include thermoplastic rubber (TPR), which may advantageously provide flexibility and energy absorption from various impacts. In some embodiments, various anti-rotation devices may include styrene-ethylene-butylene-styrene (SEBS), which may advantageously provide weather resistance and heat resistance. In various examples, various anti-rotation devices may include thermoplastic polyurethane (TPU), which may advantageously provide exceptional performance in cold temperatures, and resistance to water and various petroleum products. In some examples, various anti-rotation devices may include polyvinyl chloride (PVC), which may advantageously mix well with other substances, and may provide impact resistance. Various examples of anti-rotation devices may include silicon rubber, which may advantageously provide heat resistance, resistance to cold temperatures and electrical insulation. In some embodiments, various anti-rotation devices may include thermoset, which may advantageously provide high strength and durability. In various implementations, various anti-rotation devices may include various forms of metal or metal alloys, which may provide exceptional strength. In various implementations, some anti-rotation devices may include carbon fiber, which may advantageously be lightweight and provide high strength and rigidity. Various anti-rotation devices may include fiberglass, which may be cost-effective, lightweight and rigid. Various anti-rotation devices may include ceramic, which may be heat resistant, lightweight and rigid.

In various examples, the anti-rotation devices may include one or more colors. The color(s) may be indicative of the manufacturer or company colors. In some implementations, various colors may be combined to depict various images or lettering. Further, various anti-rotation devices may be transparent which may, for example, aid inspection and increase quality. In some implementations, various anti-rotation devices may include polyamide. Polyamide may advantageously withstand substantially high torque.

In various examples, the anti-rotation device may include one or more metals. For example, various embodiments may include aluminum, which may advantageously provide light weight and high strength. In some examples, anti-rotation device may include steel, which may provide high strength cost-effectively. Various examples of protrusions, tabs, castellations and/or pins may be rectangular prisms, which may provide straight-forward mold design. Various examples of protrusions, tabs, castellations and/or pins may be frusto-conical, which may facilitate mold release. Various examples of protrusions, tabs, castellations and/or pins may be cylindrical, which may optimize strength.

In some examples, various anti-rotation devices may be unitary with the connector disk. Further, in some examples, various anti-rotation devices may be unitary with the top cover. By way of example and not limitation, various anti-rotation devices such as, for example, some or all of the anti-rotation devices 125, 200, 400, 500, 600, 700, 800 may be configured for maintaining the top cover 120 and the connector disk 145 in a fixed rotational relationship.

In one non-limiting exemplary aspect of a strain relieving apparatus 100 for wired assemblies having a circular connection, the apparatus 100 may include a body 105 defining a first tubular interior chamber that extends between a proximal end and a distal end along a longitudinal axis 135, 325, and at least one anti-rotation member disposed in the first tubular interior chamber and defining at least one anchoring aperture 315 configured to extend longitudinally in a fixed rotational relationship with the body 105. The apparatus may further include a connector disk 145, 310 with a detachable electrical connector, and a twist-lock cap 160 configured to threadedly engage the body 105 to securably capture the connector disk 145 proximally and concentrically registered with a proximal end of the body 105. The apparatus may further include a wiring harness 155 extending through the first tubular interior chamber, wherein a distal end of the wiring harness fixedly attaches proximate to the distal end of the body 105. The apparatus may further include an anti-rotation device (ARD) 125 comprising a ring 705 configured in a cylindrical shape and to extend along the longitudinal axis between a proximal face and a distal face, the ring comprising at least one distal coupling member 210, 405 extending from the distal face and configured to insertably engage with a corresponding one of the at least one anchoring apertures 315, wherein, when the twist-lock cap 160 screwably engages the body 105 during assembly, the ARD 125 is captured between the connector-disk 145 and the body 105 and retained in a fixed orientation within the first tubular interior chamber such that the ARD 125 substantially restricts relative rotation between the connector disk 145 and the body 105.

In some exemplary embodiments, the apparatus may further include a top cover 120 defining a second tubular interior chamber that extends along the longitudinal axis 135 and is configured to coaxially align with the first tubular interior chamber proximate to the distal end, the top cover 120 further including the at least one anchoring aperture 315. The body 105 further may include threads for longitudinal engagement of the twist-lock cap 160 to the proximal end of the body 105. The ring of the ARD 125 further may include at least one proximal coupling member 140, 205 extending from the proximal face and configured to insertably engage mating recesses 320 disposed about the connector disk 145, 310. The ring of the ARD 125 further may include at least one radial detent 805.

In some implementations, the connector disk 310 further may include two or more terminals that are electrically and mechanically connected to a proximal end of the wiring harness 155. The connector disk 310 may include a connector pluggably compatible with DIN-mounted (Deutsches Institut für Normung) electrical equipment.

In some exemplary embodiments, the apparatus may further include a sensing module 110 disposed proximate to the distal end of the first tubular interior chamber. The sensing module may include at least one module terminal 115, wherein the sensing module is fixedly coupled to the body 105, and the distal end of the wiring harness 155 fixedly attaches to the at least one module terminal 115. The ARD 125 may be formed by an injection molding process, and further may be formed of a thermoplastic, which may be rated to withstand temperature up to 125 degrees Celsius. The ARD 125 may be formed as a unitary body with the connector disk, and/or formed of a visually transparent material. At least one distal coupling member 210, 405 may be press-fit into the distal face of the ring.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A strain relieving apparatus for wired assemblies having a circular connection, the apparatus comprising:

a body defining a first tubular interior chamber that extends between a proximal end and a distal end along a longitudinal axis;

at least one anti-rotation member disposed in the first tubular interior chamber and defining at least one anchoring aperture configured to extend longitudinally in a fixed rotational relationship with the body;

a connector disk comprising a detachable electrical connector;

a twist-lock cap configured to threadedly engage the body to securably capture the connector disk proximally and concentrically registered with a proximal end of the body;

a wiring harness extending through the first tubular interior chamber, wherein a distal end of the wiring harness fixedly attaches proximate to the distal end of the body; and, an anti-rotation device (ARD) comprising a ring configured in a cylindrical shape and to extend along the longitudinal axis between a proximal face and a distal face, the ring comprising at least one distal coupling member extending from the distal face and configured to insertably engage with a corresponding one of the at least one anchoring apertures, wherein, when the twist-lock cap screwably engages the body during assembly, the ARD is captured between the connector-disk and the body and retained in a fixed orientation within the first tubular interior chamber such that the ARD substantially restricts relative rotation between the connector disk and the body.

2. The apparatus of claim 1, further comprising a top cover defining a second tubular interior chamber that extends along the longitudinal axis and is configured to coaxially align with the first tubular interior chamber proximate to the distal end, the top cover further comprising the at least one anchoring aperture.

3. The apparatus of claim 1, wherein the body further comprises threads for longitudinal engagement of the twist-lock cap to the proximal end of the body.

4. The apparatus of claim 1, wherein the ring of the ARD further comprises at least one proximal coupling member extending from the proximal face and configured to insertably engage mating recesses disposed about the connector disk.

5. The apparatus of claim 4, wherein the ring of the ARD further comprises at least one radial detent.

6. The apparatus of claim 1, wherein the connector disk further comprises a plurality of terminals that are electrically and mechanically connected to a proximal end of the wiring harness.

7. The apparatus of claim 6, wherein the connector disk comprises a connector pluggably compatible with DIN-mounted (Deutsches Institut für Normung) electrical equipment.

8. The apparatus of claim 1, further comprising a sensing module disposed proximate to the distal end of the first tubular interior chamber, the sensing module comprising at least one module terminal, wherein the sensing module is fixedly coupled to the body, and the distal end of the wiring harness fixedly attaches to the at least one module terminal.

9. The apparatus of claim 1, wherein the ARD is formed by an injection molding process.

10. The apparatus of claim 9, wherein the ARD is further formed of a thermoplastic.

11. The apparatus of claim 10, wherein the thermoplastic is rated to withstand temperature up to 125 degrees Celsius.

12. The apparatus of claim 1, wherein the ARD is formed as a unitary body with the connector disk.

13. The apparatus of claim 1, wherein the ARD is formed of a visually transparent material.

14. The apparatus of claim 1, wherein the at least one distal coupling member is press-fit into the distal face of the ring.

15. A strain relieving apparatus for wired assemblies having a circular connection, the apparatus comprising:

a body defining a first tubular interior chamber that extends between a proximal end and a distal end along a longitudinal axis;

at least one anti-rotation member disposed in the first tubular interior chamber and defining at least one anchoring aperture configured to extend longitudinally in a fixed rotational relationship with the body;

a connector disk comprising a detachable electrical connector;

a twist-lock cap configured to threadedly engage the body to securably capture the connector disk proximally and concentrically registered with a proximal end of the body;

a wiring harness extending through the first tubular interior chamber, wherein a distal end of the wiring harness fixedly attaches proximate to the distal end of the body;

a top cover defining a second tubular interior chamber that extends along the longitudinal axis and is configured to coaxially align with the first tubular interior chamber proximate to the distal end, the top cover further comprising the at least one anchoring aperture; and, means for maintaining the top cover and the connector disk in a fixed rotational relationship.

16. The apparatus of claim 15, wherein the body further comprises threads for longitudinal engagement of the twist-lock cap to the proximal end of the body.

17. The apparatus of claim 15, wherein the maintaining means further comprises means for insertably engaging mating recesses disposed about the connector disk.

18. The apparatus of claim 15, wherein the connector disk further comprises a plurality of terminals that are electrically and mechanically connected to a proximal end of the wiring harness.

19. The apparatus of claim 18, wherein the connector disk comprises a connector pluggably compatible with DIN-mounted (Deutsches Institut für Normung) electrical equipment.

20. The apparatus of claim 15, further comprising a sensing module disposed proximate to the distal end of the first tubular interior chamber, the sensing module comprising at least one module terminal, wherein the sensing module is fixedly coupled to the body, and the distal end of the wiring harness fixedly attaches to the at least one module terminal.

* * * * *